United States Patent [19]

Bennett et al.

[11] Patent Number: 4,610,547

[45] Date of Patent: Sep. 9, 1986

[54] PARTICULATE MATERIAL IN A LIQUID

[75] Inventors: Adam J. Bennett; C. Edward Capes; William L. Thayer, all of Ottawa; Floyd N. Toll, Gloucester, all of Canada

[73] Assignee: Canadian Patents and Development Limited, Ottawa, Canada

[21] Appl. No.: 752,851

[22] Filed: Jul. 8, 1985

[30] Foreign Application Priority Data

Jul. 30, 1984 [CA] Canada ..... 459959

[51] Int. Cl.[4] ..... B01F 5/12; B01F 7/16

[52] U.S. Cl. ..... 366/270; 366/168; 366/290; 366/293

[58] Field of Search ..... 366/279, 293, 295, 262, 366/270, 155, 157, 168, 290, 14, 15, 302, 306, 307

[56] References Cited

U.S. PATENT DOCUMENTS

| | | | |
|---|---|---|---|
| 1,646,913 | 10/1927 | Jost | 366/290 |
| 2,530,814 | 11/1950 | Becze | 366/263 |
| 3,194,638 | 7/1965 | Neuville | 366/290 |
| 3,321,283 | 5/1967 | Ewald | 366/290 |
| 3,378,236 | 4/1968 | Kasai | 366/270 |
| 4,483,624 | 11/1984 | Bacon | 366/293 |

*Primary Examiner*—Robert W. Jenkins

*Attorney, Agent, or Firm*—Francis W. Lemon

[57] ABSTRACT

Apparatus for dispersing particulate material in a liquid, for example, particulate coal and agglomerating oil in water, comprising an upwardly extending, cylindrical container for the flow of the coal, oil and water upwardly therethrough passed a lower, flat blade type turbine rotor, an intermediate knife blade type turbine rotor and an upper pitched blade type turbine rotor. An annular shaped portion is around the intermediate rotor and houses the intermediate rotor in a cylindrical duct, longitudinally extending baffles extend upwardly along the container inner surface and are spaced therefrom. The lower rotor causes radially outward flow of the coal-water-oil mixture, the intermediate rotor causes fine break down and homogenization of the coal-water-oil mixture, while the pitched blade type turbine rotor causes reverse flow of the homogenized coal-water-oil mixture producing seed agglomerates of carbonaceous coal particles and oil leaving any ash particles dispersed in the water.

3 Claims, 1 Drawing Figure

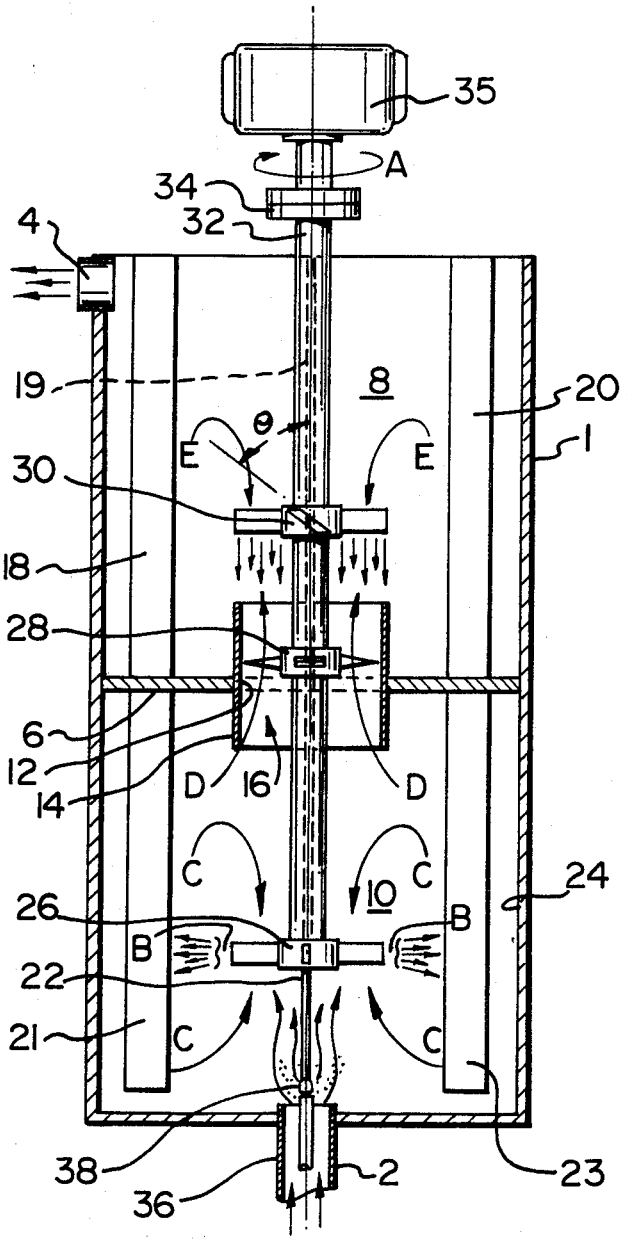
35
A
34
32
4
19
8
20
1
θ
E
E
30
18
28
6
12
14
D
16
D
C
C
10
24
26
B
B
22
21
C
C
38
36
2
23

PARTICULATE MATERIAL IN A LIQUID

This invention relates to an apparatus for dispersing a particulate material in liquid.

Turbine mixers have widely been used for dispersing particulate materials in liquids, see, for example, "Practical Tips on Designing Turbine-Mixer Systems", L. V. Casto, Chemical Engineering Calculation and Shortcut Deskbook, pages 27–32, published by McGraw-Hill, Inc., New York, U.S.A. These turbine mixers essentially comprise an open ended, vertically extending, cylindrical tank, with baffles extending upwardly above the liquid level in the tank, and a bladed turbine rotor mounted for rotation, on the lower end of a vertically extending shaft, at a central position, in a lower portion of the tank interior.

While the versatility of the turbine mixers described by L. V. Casto has resulted in them being in many processing operations, there is a need for a turbine mixer wherein the excessive mixing times of mixtures which are difficult to mix, for example, low rank coal, water, agglomerating oil mixtures, are reduced.

According to the present invention, there is provided an apparatus for dispersing particulate material in liquid, comprising:

(a) an upwardly extending cylindrical container having particulate-material-and-liquid inlet means to a lower end portion of the interior thereof and a particulate-material-and-liquid dispersion outlet from an upper end portion of the interior thereof, (b) an annular partition dividing the container interior into upper and lower compartments with a central opening therebetween, (c) a cylindrical duct forming a passageway for particulate-material-and-liquid passing through the central opening, (d) particulate-material-and-liquid flow obstructing baffles in the upper and lower compartments, the baffles being at spaced intervals around, and spaced from, the inner surface of the container, each of the baffles extending upwardly along a major intermediate portion of the compartment within which it is disposed to disrupt boundary layer flow therearound, (e) a radial flow producing flat blade type turbine rotor coaxially disposed in the lower compartment and at an intermediate position between the particulate-material-and-liquid inlet means and the partition, (f) a particulate-material-and-liquid homogenizing knife blade type turbine rotor coaxially disposed at an intermediate position in, and closely fitting in, the duct, (g) a particulate-material-and-liquid radially outward and axially downward flow producing, pitched blade type turbine rotor coaxially disposed in the upper compartment at an intermediate position between the partition and the particulate-material-and-liquid dispersion outlet, and (h) means for connecting the rotors to a driving means for rotating the rotors.

Preferably, the inlet means to the container is coaxial with the axis of rotation of the rotors, and even more desirably, the inlet means then comprises a central, oil atomizer, and a coal slurry feed pipe coaxially therearound.

In the accompanying drawing which illustrates, by way of example, an embodiment of the present invention, there is shown a partly sectional side view of an apparatus for dispersing particulate material in liquid, and which is particularly useful for dispersing agglomerating oil in an aqueous slurry of coal particles and agglomerating the carbonaceous particles of the coal.

Referring now to the drawing, there is shown an apparatus for dispersing particulate material in liquid, comprising:

(a) an upwardly extending cylindrical container 1 having particulate-material-and-liquid inlet means 2 to a lower end portion of the interior thereof, and a particulate-material-and-liquid dispersion outlet 4 from an upper end portion of the interior thereof, (b) an annular partition 6 dividing the container interior into upper and lower compartments 8 and 10, respectively, with a central opening 12 therebetween, (d) a cylindrical duct 14 forming a passageway 16 for paticulate-material-and-liquid passing through the central opening 12, (e) eight particulate-material-and-liquid flow obstructing baffles, six of which are shown and designated 18 to 23, in the upper and lower compartments 8 and 10, the baffles 18 to 23 at spaced intervals around, and spaced from; the inner surface 24 of the container 1, each of the baffles, such as those designated 18 to 23, extending upwardly along a major intermediate portion of the compartment 8 or 10 within which it is diposed to disrupt boundary layer flow therearound, (e) a radial flow producing flat blade type turbine rotor 26 coaxially disposed in the lower compartment 10 and at an intermediate position between the particulate-material-and-liquid inlet means 2 and the partition 6, (f) a particulate-material-and-liquid homogenizing, knife blade type turbine rotor 28, coaxially disposed at an intermediate position in, and closely fitting in, th duct 14, (g) a particulate-material-and-liquid radially outward and axially downward flow producing, pitched blade type turbine rotor 30 coaxially disposed in the upper compartment 8 at an intermediate position between the partition 6 and the particulate-material-and-liquid dispersion outlet 4, and (h) means, in the form of a shaft 32 and coupling 34, for connecting the rotors to a driving means, such as electric motor 35, for rotating the rotors 26, 28 and 30.

The particulate-material-and-liquid inlet means 2 comprises a pipe 36, for feeding an aqueous slurry of coal particles to the container 1, and an agglomerating oil atomizer 38 coaxially arranged in the feed pipe 36 and protruding downstream from the outlet end thereof in the container 1.

The rotors 26, 28 and 30 are mounted on the shaft 32 for rotation therewith.

In operation, the electric motor is started to rotate the rotors 26, 28 and 30 in the direction of arrow A and, for example, an aqueous coal slurry, with the coal ground to the ash release particle size, is continuously fed into the container 1 along the pipe 36, while agglomerating oil is sprayed therein by the atomizer 38.

As the aqueous coal slurry and the agglomerating oil pass upwardly in the container 1, they are first caused to flow radially outwardly, in the direction of arrows B, by the flat blade type turbine rotor 26, towards the baffles, such as those designated 21 to 23. The baffles 21 to 23 reduce any flow of the aqueous coal slurry and the agglomerating oil around shaft 32 caused by the flat blade type rotor 26 so that the predominant flow is radially outwardly in the direction of the arrows B to the container 1, and then to rebound inwardly along the curved paths indicated by arrows C. The baffles 21 to 23 are spaced from the container 1 in order to avoid the formation of stagnant areas between the baffles 21 to 23 and the container 1.

The coal-water-oil mixture eventually flows upwardly in the direction of arrows D through the cylindrical duct 14 and past the knife blade type turbine rotor 28 where fine breakdown and homogenizing of the coal-water-oil mixture occurs.

Continued upward flow of the coal-water-oil mixture occurs mainly between the baffles, such as those designated 18 to 20, while the pitched blade type turbine rotor 30 causes a radially outward axially downward flow in the direction of arrows E so that seed agglomerates are formed of the carbonaceous particles of the coal and oil leaving the ash constituent as dispersed in the water, all of which leave the container by the outlet 4.

The apparatus according to the present invention may be used, for example, to:

(i) breakdown waste coal lumps and disperse them in water, and (ii) disperse agglomerating oil in a coal fines slurry and nucleate the carbonaceous coal particle agglomeration so that carbonaceous coal particle agglomerates can be separated from ash and then grown to their final size in a low shear mixer situated downstream.

Tests, using coal feed slurry containing ash and as the agglomerating oil, were carried out in a 33 gallon (U.S.) capacity high shear mixer of the type shown in the accompanying drawing, the details of which are as follows:

Interior dimensions of container 1=18" diam×3'0" high

RPM of shaft 32=2,000

Overall diameter of rotors 26, 28 and 30=6"

Blades of rotor 26=1" wide×$\frac{1}{4}$" thick plate

Blades of rotor 28=1" wide tapering radially outward to a point ×$\frac{1}{4}$" thick plate Blades of rotor 30=1" wide×$\frac{1}{4}$" thick plate, angled at an angle $\theta$ of 45°.

The following table gives the results of tests.

TABLE

| Feed | | Rate | Oil wt. % | Product | | Tails | | Thermal | Mass |
|---|---|---|---|---|---|---|---|---|---|
| % Solids | % Ash | kg/min (db) | (wet product) | % Moisture | % Ash | % Solids | % Ash | Rec. | Yield |
| 25.4 | 39.4 | 25.9 | 0 | 26.8 | 30.3 | — | 49.2 | 59.8 | 51.2 |
| 25.5 | 38.7 | 25.4 | 3.2 | 29.8 | 29.8 | — | 69.8 | 89.3 | 75.2 |
| 26.4 | 39.3 | 28.6 | 4.6 | 33.2 | 28.2 | — | 88.1 | 97.7 | 73.7 |
| 27.2 | 32.0 | 26.3 | 6.5 | 30.7 | 14.7 | — | 89.9 | 99.1 | 75.6 |
| 20.9 | 43.4 | 23.1 | 9.4 | 33.2 | 17.0 | — | 90.9 | 100 | 67.5 |
| 9.0 | 33.6 | 11.3 | 4.0 | 22.6 | 15.9 | — | 81.1 | 95.9 | 75.6 |
| 10.2 | 32.9 | 12.6 | 6.0 | 18.7 | 12.8 | — | 86.7 | 99.1 | 81.0 |
| 10.1 | 37.1 | 8.6 | 2.1 | 32.1 | 19.3 | — | 58.1 | 71.5 | 54.4 |
| 19.1 | 38.6 | 25.2 | 2.7 | 31.2 | 22.0 | — | 81.5 | 95.1 | 74.0 |
| 18.3 | 31.2 | 19.8 | 4.3 | 32.7 | 11.5 | — | 79.3 | 99.8 | 75.5 |
| 28.7 | 38.5 | 35.1 | 6.7 | 33.9 | 14.2 | — | 76.7 | 97.4 | 71.3 |

We claim:

1. Apparatus for dispersing particulate material in a liquid, comprising:

(a) an upwardly extending cylindrical container having particulate-material-and-liquid inlet means to a lower end portion of the interior thereof and a particulate-material-and-liquid dispersion outlet from an upper end portion of the interior thereof, (b) an annular partition dividing the container interior into upper and lower compartments with a central opening therebetween, (c) a cylindrical duct forming a passageway for particulate-material-and-liquid passing through the central opening, (d) particulate-material-and-liquid flow obstructing baffles in the upper and lower compartments, the baffles being at spaced intervals around, and spaced from, the inner surface of the container, each of the baffles extending upwardly along a major intermediate portion of the compartment within which it is disposed to disrupt boundary layer flow therearound, (e) a radial flow producing flat blade type turbine rotor coaxially disposed in the lower compartment and at an intermediate position between the particulate-material-and-liquid inlet means and the partition, (f) a particulate-material-and-liquid homogenizing knife blade type turbine rotor coaxially disposed at an intermediate position in, and closely fitting in, the duct, (g) a particulate-material-and-liquid radially outward an axially downward flow producing, pitched blade type turbine rotor coaxially disposed in the upper compartment at an intermediate position between the partition and the particulate-material-and-liquid dispersion outlet, and (h) means for connecting the rotors to a driving means for rotating the rotors.

2. Apparatus according to claim 1, wherein the inlet means to the container is coaxial with the axis of rotation of the rotors.

3. Apparatus according to claim 2 wherein the inlet means comprises a central, oil atomizer, and a coal slurry feed pipe coaxially therearound.

* * * * *